US012011050B2

(12) United States Patent
Kobayashi et al.

(10) Patent No.: US 12,011,050 B2
(45) Date of Patent: Jun. 18, 2024

(54) BRASSIERE

(71) Applicant: FAST RETAILING CO., LTD., Yamaguchi (JP)

(72) Inventors: Satomi Kobayashi, Yamaguchi (JP); Hiromi Nakatani, Yamaguchi (JP); Yanxia Luo, Yamaguchi (JP)

(73) Assignee: FAST RETAILING CO., LTD., Yamaguchi (JP)

( * ) Notice: Subject to any disclaimer, the term of this patent is extended or adjusted under 35 U.S.C. 154(b) by 164 days.

(21) Appl. No.: 17/762,388

(22) PCT Filed: Sep. 18, 2020

(86) PCT No.: PCT/JP2020/035607
§ 371 (c)(1),
(2) Date: Mar. 22, 2022

(87) PCT Pub. No.: WO2021/060216
PCT Pub. Date: Apr. 1, 2021

(65) Prior Publication Data

US 2022/0338560 A1 Oct. 27, 2022

(30) Foreign Application Priority Data

Sep. 25, 2019 (JP) ..... 2019-003620

(51) Int. Cl.
*A41C 3/00* (2006.01)

(52) U.S. Cl.
CPC ..... *A41C 3/0071* (2013.01)

(58) Field of Classification Search
CPC ..... A41C 3/0071
(Continued)

(56) References Cited

U.S. PATENT DOCUMENTS 3,568,681 A * 3/1971 Comollo ..... A41C 3/148 623/7
5,098,330 A * 3/1992 Greenberg ..... A41C 3/10 450/55

(Continued)

FOREIGN PATENT DOCUMENTS

CN 202068949 U 12/2011
JP 3023713 U 4/1996

(Continued)

OTHER PUBLICATIONS

International Search Report issued in corresponding International Application No. PCT/JP2020/035607 dated Nov. 24, 2020, pp. 1-3, English Translation.

(Continued)

*Primary Examiner* — Gloria M Hale
(74) *Attorney, Agent, or Firm* — Carter, DeLuca & Farrell LLP

(57) ABSTRACT

Provided is a brassiere allowing for selecting a plurality of types of pads.
A brassiere (1) includes a first pocket (70) that holds a pad (90 to 95) inside a cup portion (2), and further includes a second pocket (80) inside the cup portion (2). The first pocket (70) includes a first pocket opening (72) through which the pad (90 to 95) is taken in and out, and a first opening portion (73) communicating with the first pocket opening (72). The first pocket opening (72) is covered with the second pocket (80). The second pocket (80) includes a second pocket opening (82) through which the pad (90 to 95) is taken in and out, and a second opening portion (83) communicating with the first pocket opening (72).

6 Claims, 9 Drawing Sheets

(58) Field of Classification Search
USPC ..... 450/89, 54–57
See application file for complete search history.

(56) References Cited

U.S. PATENT DOCUMENTS

| | | | | |
|---|---|---|---|---|
| 5,395,280 | A * | 3/1995 | Greenberg | A41C 3/148 450/55 |
| 10,791,773 | B2 * | 10/2020 | Hirakubo | A41C 3/10 |
| 2004/0002288 | A1 | 1/2004 | Bell et al. | |
| 2011/0237157 | A1 * | 9/2011 | Scott | A41C 3/0021 450/63 |
| 2017/0265530 | A1 | 9/2017 | Donlon et al. | |

FOREIGN PATENT DOCUMENTS

| | | | |
|---|---|---|---|
| JP | 3086371 | U | 6/2002 |
| JP | 2004-332134 | A | 11/2004 |
| JP | 2005-536650 | A | 12/2005 |
| JP | 3118227 | U | 1/2006 |
| JP | 2008-75191 | A | 4/2008 |
| JP | 2009-068141 | A | 4/2009 |
| JP | 5588076 | B1 | 9/2014 |
| JP | 6472921 | B1 | 2/2019 |

OTHER PUBLICATIONS

Korean Office Action issued in corresponding KR Patent Application No. 20-2022-7000015, dated Dec. 1, 2023, together with English translation.

* cited by examiner

[FIG.1]
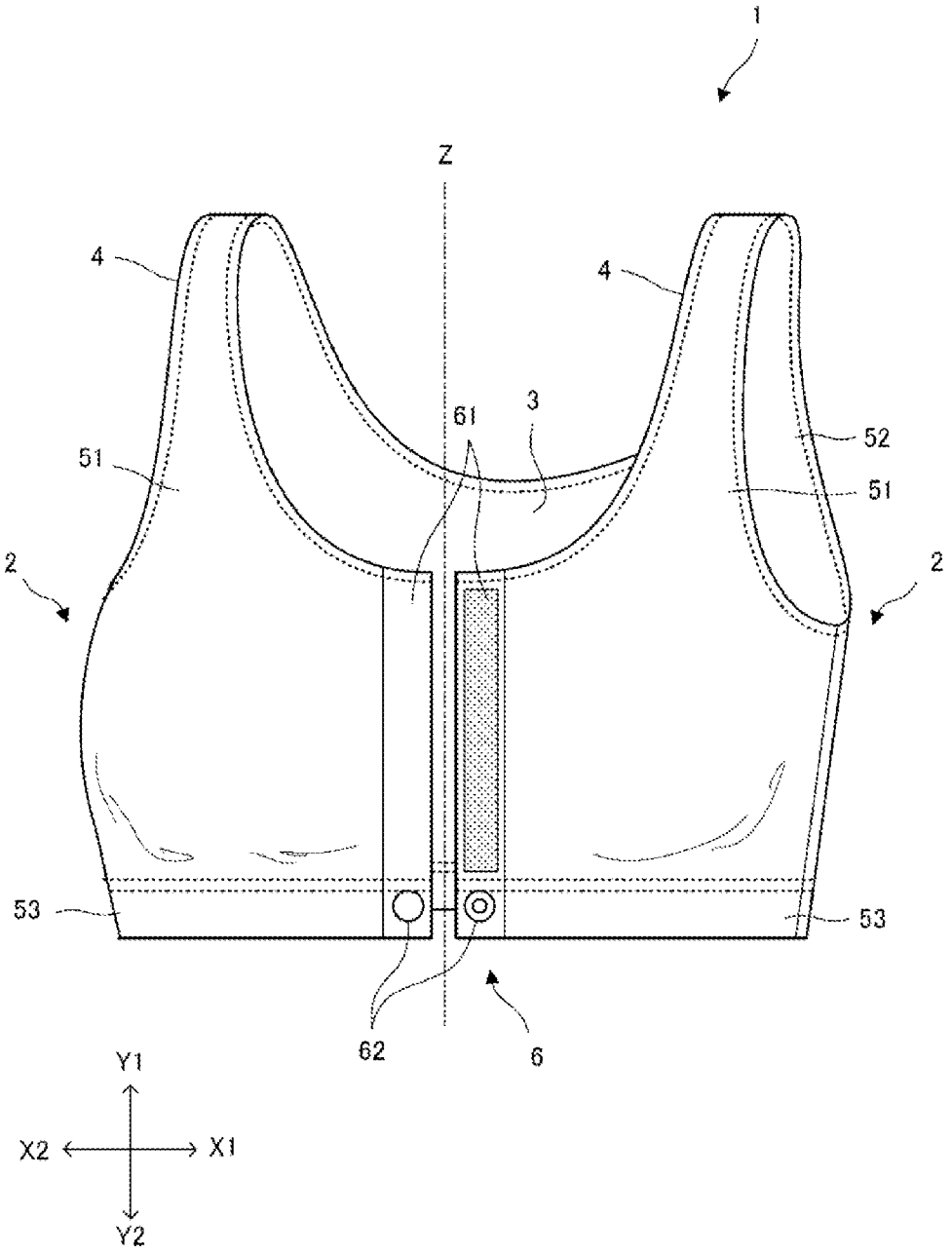

[FIG.2]
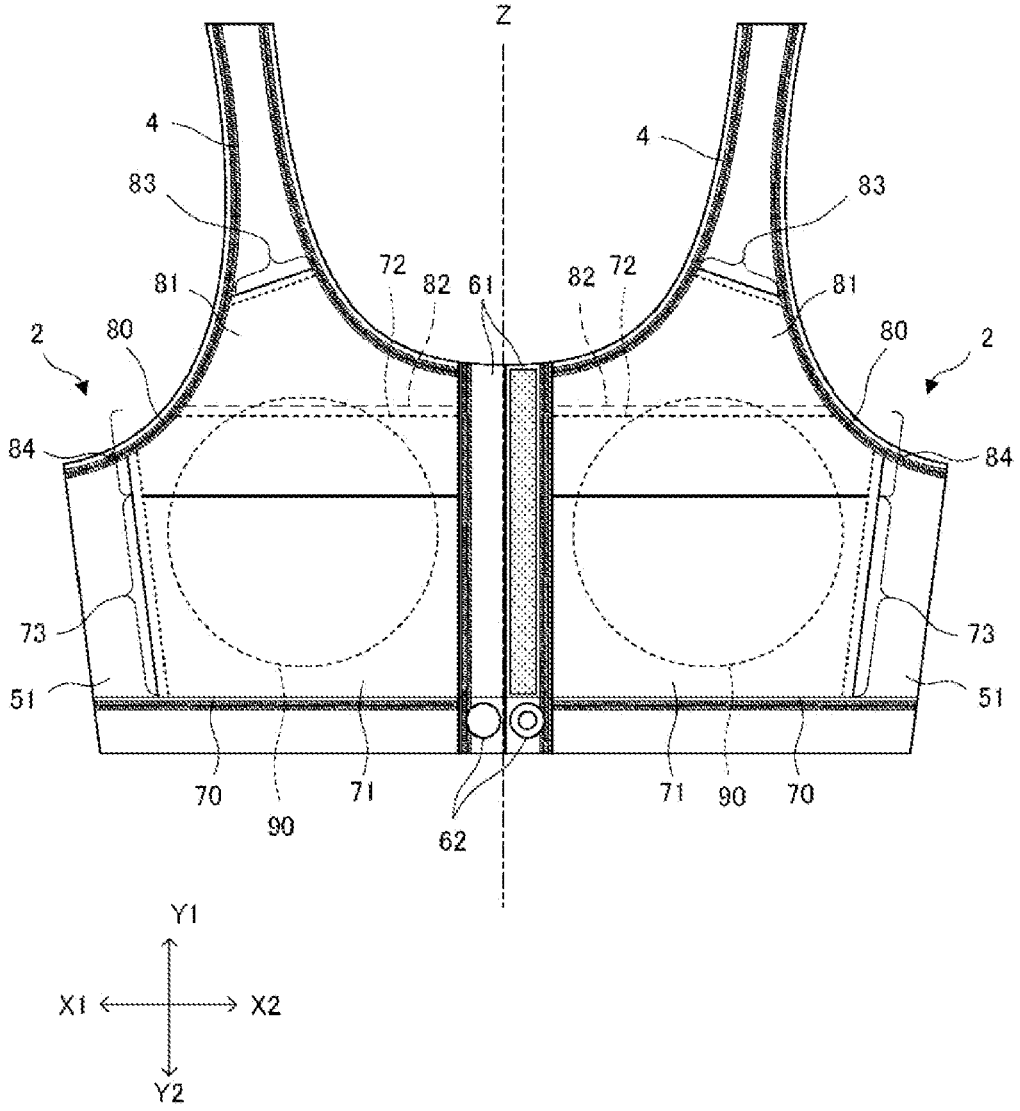

[FIG.3]
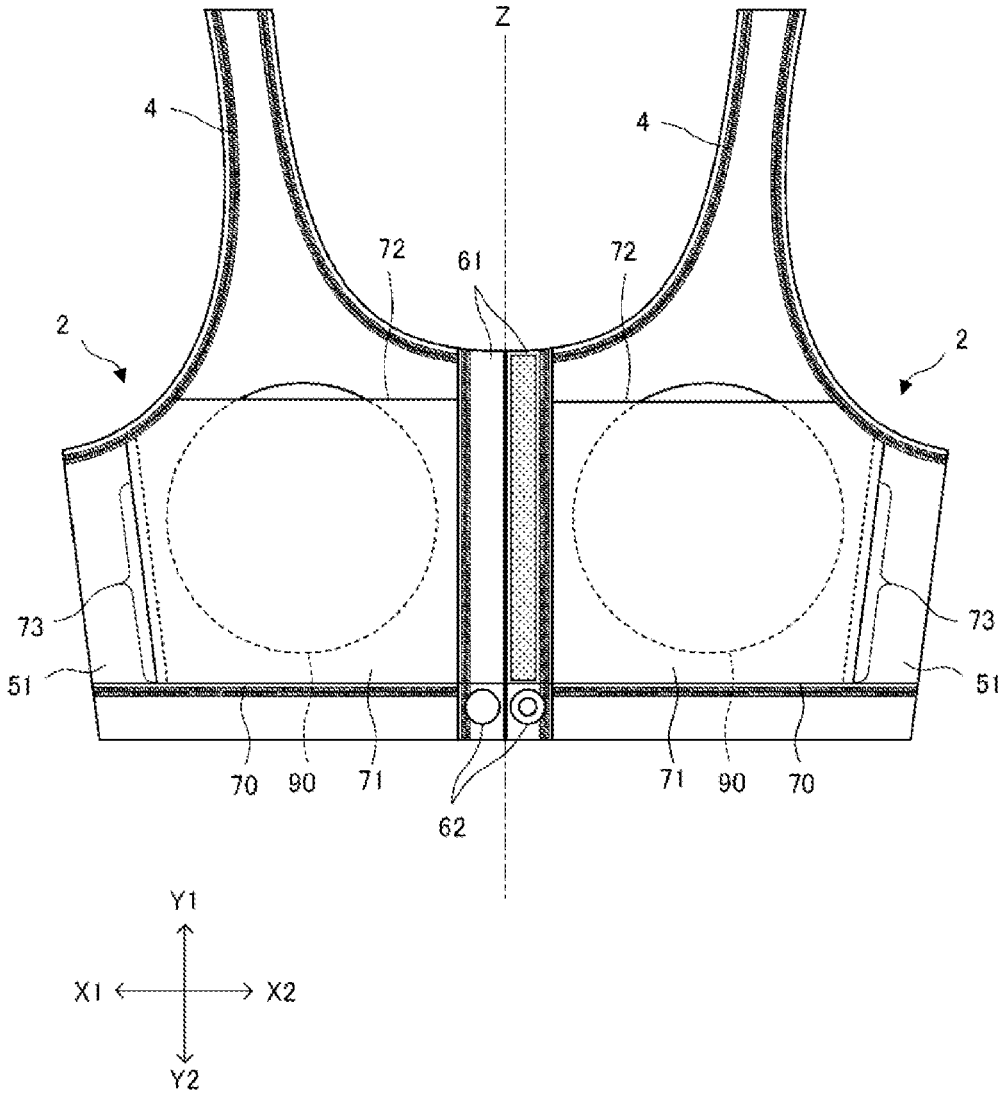

[FIG.4]
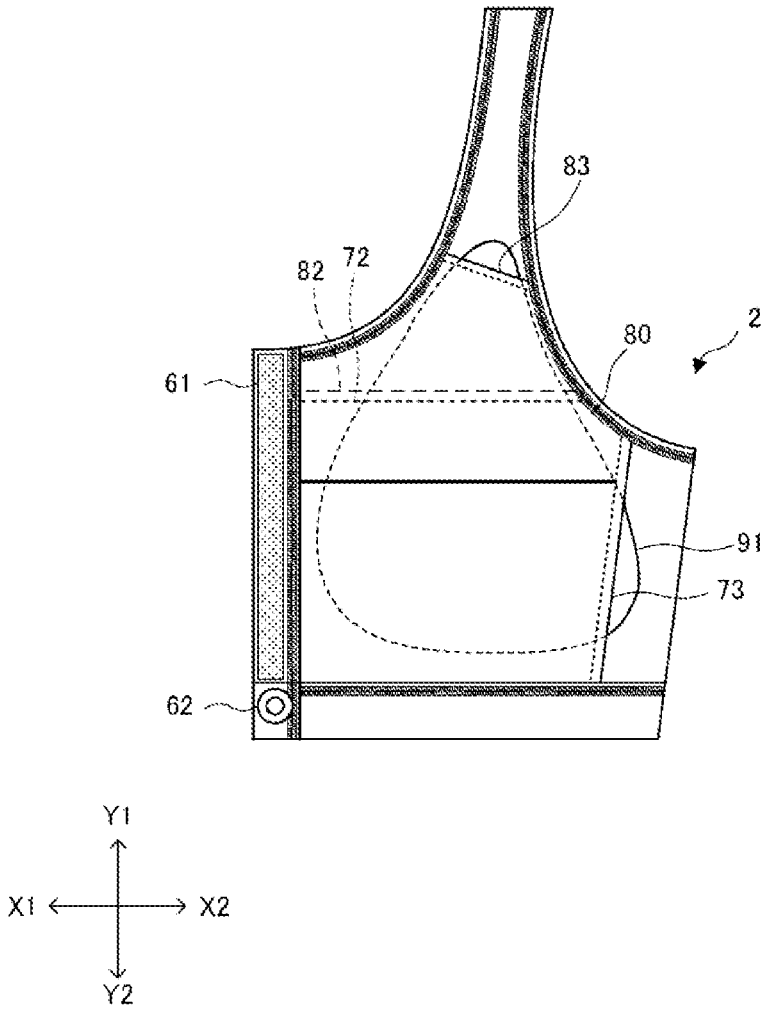

[FIG.5]
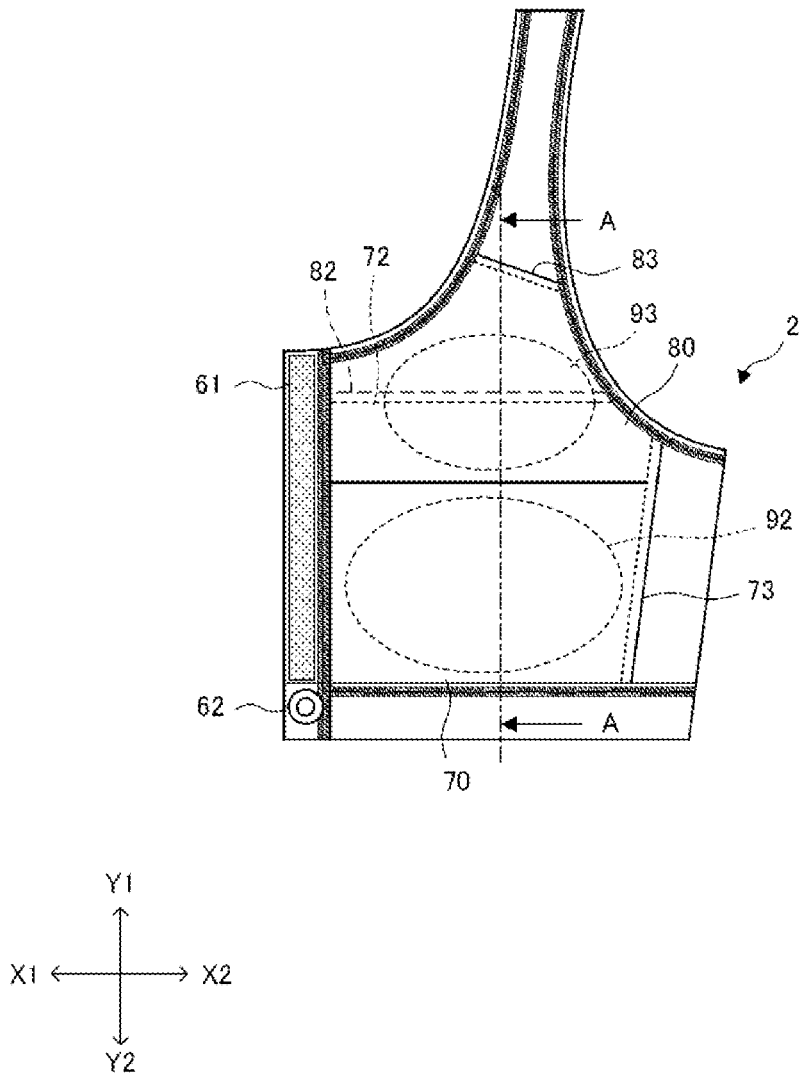

[FIG.6]
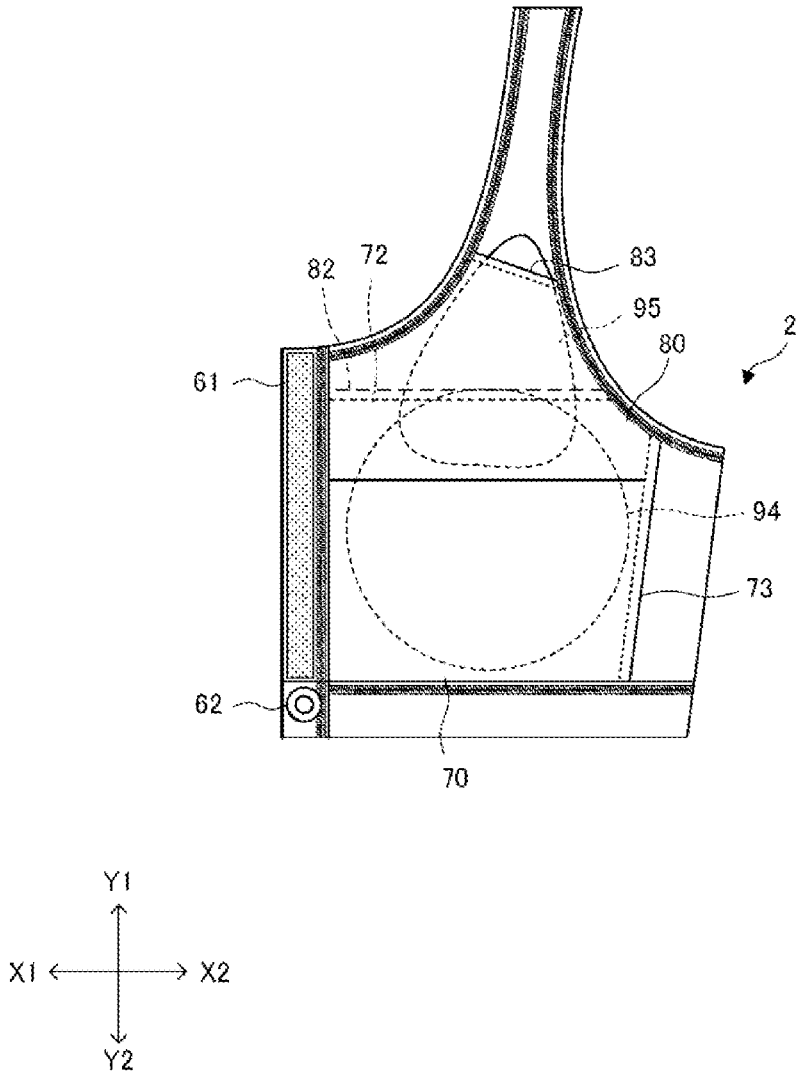

[FIG.7A]
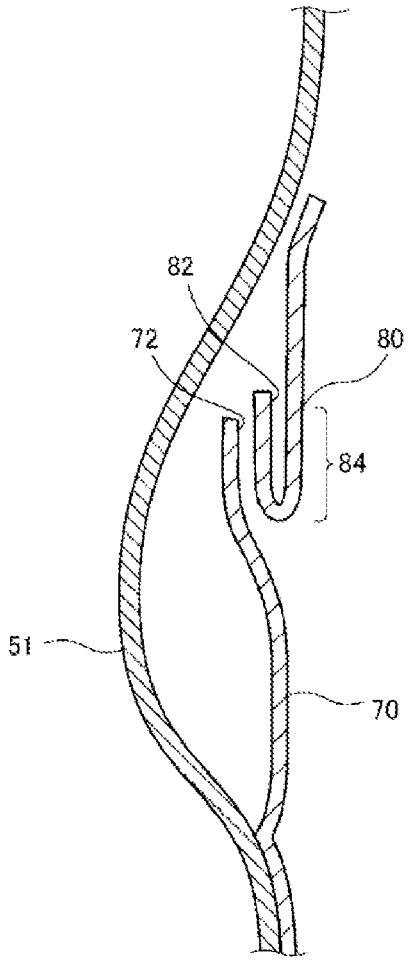

[FIG.7B]
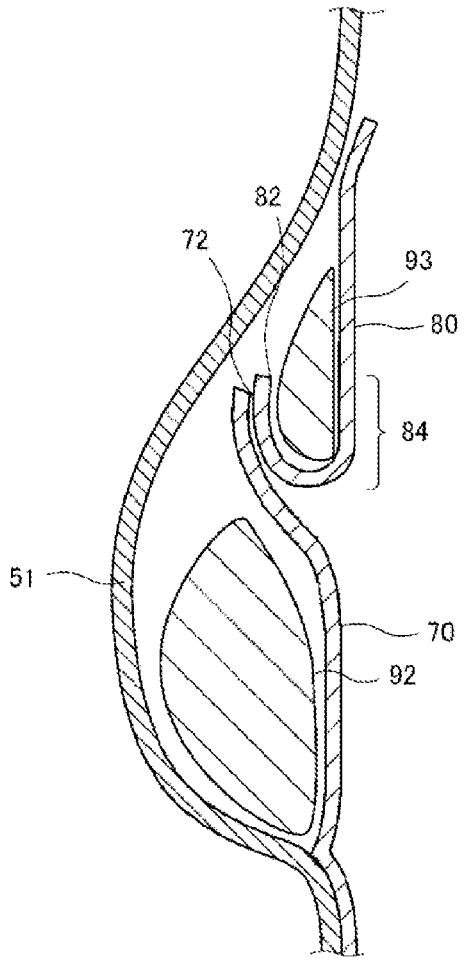

[FIG.8]
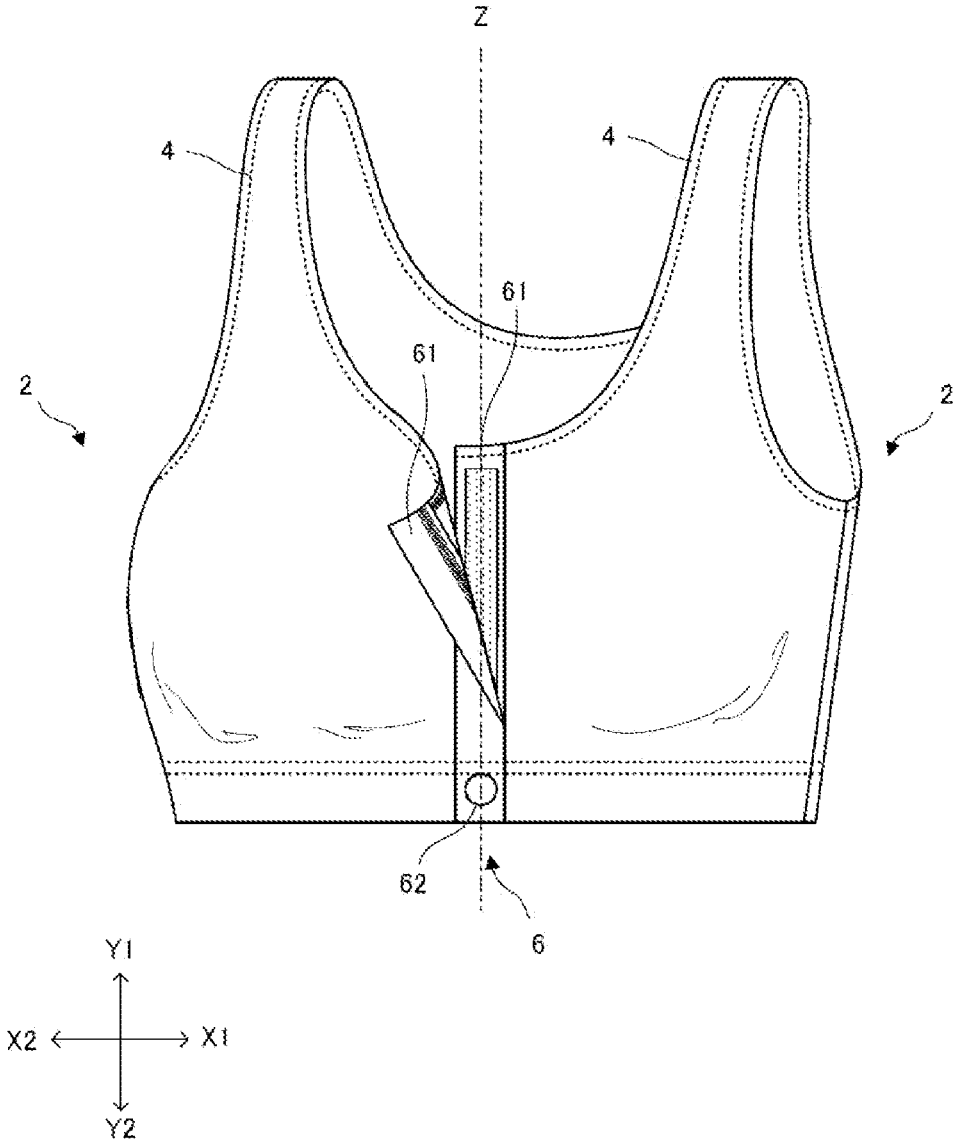

BRASSIERE

CROSS REFERENCE TO RELATED APPLICATIONS

The present application is a national stage application of International Application No. PCT/JP2020/035607, filed Sep. 18, 2020, which claims the benefit of and priority to Japanese Patent Application No. 2019-003620, filed Sep. 25, 2019, the entire contents of each of which are hereby incorporated by reference herein in their entirety.

TECHNICAL FIELD

The present invention relates to a brassiere.

BACKGROUND ART

Some brassieres are provided with pads inside cup portions. Particularly in medical brassieres for patients whose breasts have been removed due to breast cancer or the like, pads are used for the purpose of shaping breasts such as making a bustline natural.

Specifically, a pocket for a pad to be taken in and out is provided inside a cup portion to store the pad (see Patent Literature 1).

There are also proposed a brassiere in which two pockets limit movement of a pad (see Patent Literature 2) and a brassiere in which overlapping a plurality of pockets having different sizes inside a cup portion allows for selecting the size of a pad (see Patent Literature 3).

CITATION LIST

Patent Literature

Patent Literature 1: JP 3118227 U
Patent Literature 2: JP 5588076 B1
Patent Literature 3: JP 2004-332134 A

SUMMARY OF INVENTION

Technical Problem

In the case of a medical brassiere, many types of pads having different sizes and shapes are provided so that the pads can be selected according to the state of a breast. Some pads can be used in combination with another pad.

However, according to Patent Literatures 1 and 2, the pocket can accommodate one pad, but not a plurality of pads. Thus, it is not possible to use two types of pads in combination.

According to Patent Literature 3, the plurality of pockets each may be able to accommodate a pad, but overlap each other inside the cup portion. Thus, it is not possible to select the position of holding the pad, and to shape a breast by combining a plurality of pads.

An object of the present invention is to provide a brassiere allowing for selecting a plurality of types of pads.

Solution to Problem

A brassiere (1) according to an aspect of the present invention includes a first pocket (70) that holds a pad (90 to 95) inside a cup portion (2), and further includes a second pocket (80) inside the cup portion (2), wherein the first pocket (70) includes a first pocket opening (72) through which the pad (90 to 95) is taken in and out, and a first opening portion (73) communicating with the first pocket opening (72), the first pocket opening (72) is covered with the second pocket (80), and the second pocket (80) includes a second pocket opening (82) through which the pad (90 to 95) is taken in and out, and a second opening portion (83) communicating with the first pocket opening (72).

Advantageous Effects of Invention

According to the present invention, it is possible to provide a brassiere allowing for selecting a plurality of types of pads.

BRIEF DESCRIPTION OF DRAWINGS

FIG. 1 is a perspective view illustrating an appearance of a brassiere of a present embodiment.

FIG. 2 is a plan view illustrating the brassiere of the present embodiment from an inside.

FIG. 3 is a plan view of the brassiere illustrated in FIG. 2 excluding a second pocket.

FIG. 4 is a plan view illustrating an example of storing a pad.

FIG. 5 is a plan view illustrating an example of storing pads.

FIG. 6 is a plan view illustrating an example of storing pads.

FIG. 7A is a cross-sectional view taken along line A-A in FIG. 5 before the pads are stored.

FIG. 7B is a cross-sectional view taken along line A-A in FIG. 5 after the pads are stored.

FIG. 8 is a perspective view illustrating a state in which connecting portions connect lower sides of front center sides of cup portions.

DESCRIPTION OF EMBODIMENTS

Hereinafter, an embodiment of a brassiere of the present invention will be described with reference to the drawings. A configuration described below is an embodiment of the present invention, and the present invention is not limited to the configuration.

In the following description, the term "upper" refers to a direction Y1 in the drawings, and the term "lower" refers to a direction Y2 in the drawings. The term "right" refers to a direction X1 in the drawings, and the term "left" refers to a direction X2 in the drawings.

FIG. 1 illustrates an appearance of a brassiere 1 of an embodiment of the present invention.

As illustrated in FIG. 1, the brassiere 1 includes a pair of cup portions 2, a back portion 3, and a pair of shoulder portions 4.

The cup portions 2 cover wearer's breasts. The back portion 3 extends from underarm sides of the right and left cup portions 2 to wearer's back to cover the back. The shoulder portions 4 connect the cup portions 2 to the back portion 3, and are hung on wearer's right and left shoulders.

For example, the brassiere 1 has front bodies 51 and a back body 52 each having a neckline and an armhole, and is formed by connecting the front bodies 51 to the back body 52 on respective shoulder sides and underarm sides.

The front bodies 51 and the back body 52 are preferably made of a flexible and stretchable material so that the wearer can easily move. A sweat-absorbent material, which can improve comfort during wearing the brassiere 1, is also preferable. Examples of such a material include cotton, acrylic, nylon, and polyurethane.

The brassiere 1 of the present embodiment includes a stretchable member 53 such as rubber provided at lower edges of the cup portions 2. The stretchable member 53 facilitates fitting of the brassiere 1 to a wearer's body.

In the present embodiment, the pair of cup portions 2 is divided at a front center Z. The brassiere 1 includes connecting portions 6 on front center Z sides of the divided cup portions 2. The connecting portions 6 can connect and separate the cup portions 2.

(Cup Portion)

FIG. 2 is a plan view illustrating the brassiere 1 from an inside, where it comes in contact with the wearer.

As illustrated in FIG. 2, the brassiere 1 includes a first pocket 70, a second pocket 80, and a pad 90 inside each cup portion 2.

FIG. 3 is a plan view illustrating the cup portions 2 from the inside excluding the second pockets 80.

As illustrated in FIGS. 2 and 3, the second pocket 80 is located inside the first pocket 70, that is, on a wearer side of the first pocket 70.

(First Pocket)

The first pocket 70 includes a first pocket fabric 71, a first pocket opening 72, and a first opening portion 73. The pad 90 can be taken in and out of the first pocket 70 through the first pocket opening 72.

The first pocket fabric 71 is sewn to the front body 51 along a front center Z side edge, along a lower side edge, and on an upper side of an underarm side edge of the first pocket fabric 71.

The first pocket fabric 71 is preferably made of a stretchable material. This improves comfort during wearing the brassiere 1, and allows the pad 90 to be easily taken in and out.

The first pocket fabric 71 of the present embodiment has a square shape, but the shape is not particularly limited.

The first pocket opening 72 opens upward. The first pocket opening 72 is an upper part of the first pocket fabric 71, where it is not sewn to the front body 51.

The upper edge of the first pocket opening 72 may be turned back to an outside. The term "outside" refers to a side opposite to the inside. This turnback is likely to prevent the pad 90 stored in the first pocket 70 from falling out through the first pocket opening 72.

The second pocket 80 is placed on the first pocket opening 72, and covers the first pocket opening 72. The second pocket 80 of the present embodiment is located on an upper side of the first pocket 70, and a part of a lower side of the second pocket 80 covers the first pocket opening 72.

The part of the second pocket 80 covering the first pocket opening 72 serves as a flap portion 84 of the first pocket opening 72. The flap portion 84 can suppress falling of the pad 90 through the first pocket 70.

The first opening portion 73 opens to an underarm side. The first opening portion 73 is a part of the underarm side of the first pocket fabric 71, where it is not sewn to the front body 51. Specifically, the first pocket fabric 71 is sewn to the front body 51 on the upper side of the underarm side edge, that is, at a part overlapping the flap portion 84, and opens without being sewn on a lower side of the underarm side edge below the flap portion 84.

The first opening portion 73 communicates with the first pocket opening 72.

In the present embodiment, the first pocket 70 is larger in size than the second pocket 80.

(Second Pocket)

The second pocket 80 includes a second pocket fabric 81, a second pocket opening 82, and a second opening portion 83. The pad 90 can be taken in and out of the second pocket 80 through the second pocket opening 82.

The second pocket fabric 81 has a lower part that is turned back, and is sewn to the front body 51 along a front center Z side edge, an underarm side edge, a neckline side edge, and an armhole side edge of the second pocket fabric 81. The turnback part is a bottom of the second pocket 80. This bottom is placed on the first pocket opening 72 and serves as the flap portion 84.

The second pocket fabric 81 is preferably made of a stretchable material. This improves comfort during wearing the brassiere 1, and allows the pad 90 to be easily taken in and out.

The second pocket fabric 81 has an upper edge having a substantially mountain-like shape extending upward from the front center Z along the neckline, obliquely downward from the neckline, and downward along the armhole. The underarm side edge and the front center Z side edge of the second pocket fabric 81 extend downward from the upper edge toward a lower edge. The lower edge of the second pocket 81 is located below the first pocket opening 72.

The shape of the second pocket fabric 81 is not limited to this. For example, a part of the upper edge of the second pocket fabric 81 forming the second opening portion 83 may extend horizontally from the neckline to the armhole.

The second pocket opening 82 opens upward. The second pocket opening 82 is an opening at an upper part of the turnback of the second pocket fabric 81.

The second opening portion 83 opens upward. The second opening portion 83 is a part of the second pocket fabric 81 on the shoulder portion 4 of the front body 51, where the second pocket fabric 81 is not sewn to the front body 51.

The second opening portion 83 communicates with the first pocket opening 72 and the first opening portion 73. The second opening portion 83 also communicates with the second pocket opening 82.

In the present embodiment, the second pocket 80 from the upper edge to the lower edge is shallower in depth than the first pocket opening 72.

(Pad)

The pad 90 of the present embodiment is held by the first pocket 70 inside the cup portion 2, but may be held by the second pocket 80 inside the cup portion 2. Furthermore, one or more types of pads 90 may be held by the first pocket 70 and the second pocket 80 separately.

As a material of the pad 90, a flexible and elastic material such as urethane, silicon, cotton, or nonwoven fabric can be used. The pad 90 may be a disposable pad.

The pad 90 is held on an upper side of the cup portion 2 when stored in the first pocket 70, and is held on a lower side of the cup portion 2 when stored in the second pocket 80.

The pad 90 of the present embodiment has a circular shape, but the shape is not particularly limited. The pad 90 may have, for example, a triangular shape, an elliptical shape, a quadrangular shape, a lemon shape, or the like, or may have an irregular shape.

The pad 90 of the present embodiment has a size that fits in the first pocket 70. However, it is also possible to use a pad 90 having a size such that a part of the pad 90 extends beyond the first pocket 70 or the second pocket 80.

For example, a part of a pad 90 in the first pocket 70 can be exposed from the first opening portion 73 or the second opening portion 83 communicating with the first pocket opening 72. Similarly, a part of a pad 90 in the second pocket 80 can be exposed from the second opening portion 83 communicating with the second pocket opening 72.

The pads 90 in the first pocket 70 and the second pocket 80 may have the same or different shapes and sizes.

FIGS. 4 to 6 illustrate examples of pads 91 to 95 held in the cup portion 2.

FIG. 4 illustrates an example of a triangular pad 91. The pad 91 has a large size that covers a breast and an upper side of the breast, and is held by the first pocket 70. The pad 91 has an upper side a part of which is exposed from the second opening portion 83, and an underarm side a part of which is exposed from the first opening portion 73.

FIG. 5 illustrates an example of two pads 92 and 93 having different sizes. The pads 92 and 93 each have an elliptical shape. The pad 92 is held by the first pocket 70, and the pad 93 smaller in size than the pad 92 is held by the second pocket 80.

FIG. 6 illustrates an example of two pads 94 and 95 having different shapes. The pad 94 held by the first pocket 70 has a circular shape, and the pad 95 held by the second pocket 80 has a triangular shape. The pad 94 has an upper side a part of which is exposed from the second opening portion 83.

The numbers and types of pads 90 used in respective cup portions 2 may be the same or different. For example, the pad 91 illustrated in FIG. 4 may be used in the right cup portion 2, and the pads 92 and 93 illustrated in FIG. 5 may be used in the left cup portion 2. The pad 90 may not be used in one of the cup portions 2, and may be used only in the other of the cup portions 2.

As described above, the first pocket 70 and the second pocket 80 allow for selecting the numbers and types of pads 90 to be used in the right and left cup portions 2. It is also possible to select the position of holding the pad 90 by storing it in the lower first pocket 70 or in the upper second pocket 80.

Therefore, the brassiere 1 is particularly useful as a medical brassiere for a patient whose breast has been removed. The one-size brassiere 1 allows the pad 90 to be selected according to the wearer, and is thus highly versatile.

(Pad Holding Method)

FIGS. 7A and 7B are cross-sectional views taken along line A-A in FIG. 5. FIG. 7A illustrates a state before the pads 92 and 93 are stored, and FIG. 7B illustrates a state after the pads 92 and 93 are stored.

When the pad 92 is held by the first pocket 70, the flap portion 84 is lifted for the pad 92 to be inserted between the first pocket 70 and the second pocket 80. Next, the pad 92 is inserted into the first pocket 70 through the first pocket opening 72.

When the pad 93 is held by the second pocket 80, the flap portion 84 is similarly lifted for the pad 92 to be inserted between the first pocket 70 and the second pocket 80. The pad 93 is further lifted to the upper side of the first pocket 70, and is inserted into the second pocket 80 through the second pocket opening 82.

(Connecting Portion)

The connecting portions 6 include a pair of strips of hook-and-loop fastener 61 and a pair of parts of snap button 62.

The strips of hook-and-loop fastener 61 are provided at front center Z side edges of the right and left cup portions 2. One of the strips of hook-and-loop fastener 61 has a bonding surface provided inside one of the cup portion 2, and the other of the strips of hook-and-loop fastener 61 has a bonding surface provided outside the other of the cup portion 2.

In the present embodiment, one strip of hook-and-loop fastener 61 is provided on a surface entirely from the lower edge to the upper edge on the front center Z side of the cup portion 2, but a plurality of strips of hook-and-loop fasteners 61 may be provided at intervals from the lower edge to the upper edge.

The parts of snap button 62 are provided on the stretchable member 53 below the strips of hook-and-loop fastener 61 on the front center Z sides of the cup portions 2. Although only the hook-and-loop fastener 61 can make a connection, engaging the pair of parts of snap button 62 makes the connecting operation easy and facilitates maintaining the connecting state.

FIG. 8 illustrates how to connect the right and left cup portions 2 from the lower side.

As illustrated in FIG. 8, after the parts of snap button 62 are engaged to fix the positions of the right and left cup portions 2 at the front center Z, the strips of hook-and-loop fastener 61 can be bonded even with one hand by bonding the strips of hook-and-loop fastener 61 from the lower side to the upper side.

The easy operations of connecting and releasing the cup portions 2 allow even a weak-handed wearer, for example, a patient after mastectomy or an elderly person to easily fasten and unfasten the brassiere 1. It is also easy for a person who assists in putting on the brassiere1, such as a caregiver, to fasten and unfasten the brassiere 1.

As described above, according to the brassiere 1 of the present embodiment, the first pocket 70 and the second pocket 80 provided inside the cup portion 2 allow for selecting and using two or more types of pads 90.

The first pocket opening 72 of the first pocket 70 is covered with the second pocket 80, which can suppress falling of the pad 90 out of the first pocket 70.

Since the first pocket opening 72 communicates with the first opening portion 73 and the second opening portion 83, the pad 90 stored in the first pocket 70 can be exposed from the first opening portion 73 or the second opening portion 83. It is possible to store the pad 90 exceeding in size the first pocket 70, which can improve the degree of freedom of the size of the pad 90 to be held.

Although the preferred embodiments of the present invention have been described above, the present invention is not limited to these embodiments, and various modifications and changes can be made within the scope of the gist of the present invention.

For example, the present invention can be applied not only to a brassiere but also to a tank top, slip, camisole, and dress having cups. The present invention can also be applied to any garment that has cup portions for supporting breasts and can shape the breasts with pads, that is, maintain or arrange the shapes of the breasts, such as a bodysuit, a basque, a leotard, and a swimsuit.

In the above embodiment, the first pocket 70 is larger in size than the second pocket 80, but the second pocket 80 may be larger in size than the first pocket 70 depending on the size of the pad 90 to be stored or the like.

Similarly, the second pocket 80 from the upper edge to the lower edge may be deeper in depth than the first pocket opening 72 depending on the size of the pad 90 to be stored or the like.

In the above embodiment, the pair of cup portions 2 is divided at the front center Z, but may be divided at a rear center, or may not be divided.

The connecting portions 6 may include a pair of parts of hook-and-eye provided at the front center Z sides of the right and left cup portions 2 to connect and separate the cup portions 2 by locking and unlocking the parts of hook-and-eye. The hook-and-eye is also called hook eye, hook-and-eye closure, or the like.

The connecting portions 6 may employ one of the snap button 62, the hook-and-loop fastener 61, and the hook-and-eye singly or two or more of those in combination to separate and connect the cup portions 2.

The present application claims priority based on Japanese Utility Model Application JP 2019-003620 U filed on Sep. 25, 2019, the entire description of which is incorporated herein by reference.

REFERENCE SIGNS LIST

1 Brassiere
2 Cup portion
70 First pocket
72 First pocket opening
73 First opening portion
80 Second pocket
82 Second pocket opening
83 Second opening portion
84 Flap portion
90 to 95 Pad
6 Connecting portion

The invention claimed is:

1. A brassiere comprising:

a first pocket that holds a pad inside a cup portion, the brassiere further comprising:

a second pocket inside the cup portion, wherein the first pocket includes a first pocket opening through which the pad is taken in and out, and a first opening portion communicating with the first pocket opening, the first pocket opening is covered with the second pocket, the second pocket includes a second pocket opening through which the pad is taken in and out, the first pocket is larger in size than the second pocket, the second pocket is located above the first pocket and covers the first pocket opening, and the second pocket is shallower in depth than the first pocket.

2. The brassiere according to claim 1, wherein the first opening portion opens to an underarm side.

3. The brassiere according to claim 1, wherein the second pocket is located inside the first pocket.

4. The brassiere according to claim 1, wherein the first pocket and the second pocket are made of a stretchable material.

5. A brassiere comprising a first pocket that holds a pad inside a cup portion, the brassiere further comprising:

a second pocket inside the cup portion, wherein the first pocket includes a first pocket opening through which the pad is taken in and out, and a first opening portion communicating with the first pocket opening, the first pocket opening is covered with the second pocket, the second pocket includes a second pocket opening through which the pad is taken in and out, the first pocket opening opens upward, the second pocket includes a second pocket fabric positioned on an upper side of the first pocket, and a lower part of the second pocket fabric is turned back to form a bottom of the second pocket, and the bottom of the second pocket is placed on the first pocket opening to provide a flap portion of the first pocket opening.

6. The brassiere according to claim 1, comprising connecting portions on front center sides of a pair of the cup portions, wherein the connecting portions include at least one of a snap button, a hook-and-loop fastener, and a hook and eye, and separate and connect the front center sides of the pair of the cup portions.

* * * * *